US005577880A

United States Patent [19]

Krauter

[11] Patent Number: 5,577,880

[45] Date of Patent: Nov. 26, 1996

[54] ASSEMBLY FOR FEEDING FUEL OUT OF A SUPPLY TANK TO THE INTERNAL COMBUSTION ENGINE OF A MOTOR VEHICLE

[75] Inventor: Lothar Krauter, Bietigheim-Bissingen, Germany

[73] Assignee: Robert Bosch GmbH, Stuttgart, Germany

[21] Appl. No.: 523,478

[22] Filed: Sep. 5, 1995

[30] Foreign Application Priority Data

Oct. 7, 1994 [DE] Germany ..... 44 35 883.0

[51] Int. Cl.[6] ..... F01D 1/12

[52] U.S. Cl. ..... 415/55.1

[58] Field of Search ..... 415/55.1, 55.2, 415/55.3, 55.4, 55.5

[56] References Cited

U.S. PATENT DOCUMENTS 5,039,284 8/1991 Talaski ..... 415/55.1

FOREIGN PATENT DOCUMENTS 9210600 8/1992 Germany .

*Primary Examiner*—John T. Kwon

*Attorney, Agent, or Firm*—Michael J. Striker

[57] ABSTRACT

The feed assembly (14) has a feed pump (20) with a vane wheel (24) rotating in a pump chamber (30). The pump chamber (30) is delimited in the direction of the axis of rotation (25) of the vane wheel (24) by two walls (32, 34), one wall (32) of which is arranged in a stationary manner. The other wall (34) is guided movably in the direction of the axis of rotation (25) in a cylindrical wall portion (50) and, on its end face facing away from the vane wheel (24), is loaded at least in regions by the feed pressure prevailing on the delivery side of the feed pump (20). When the feed assembly (14) is in Operation, there acts on the movable wall (34) a pressure force which presses this against the vane wheel (24) and the latter against the stationary wall (32), so that the vane wheel (24) is arranged in the pump chamber (30) without axial play in the direction of the axis of rotation (25). Jamming of the vane wheel (24) is not possible, since the movable wall (34) can shift in the direction of the axis of rotation (25).

9 Claims, 2 Drawing Sheets

ASSEMBLY FOR FEEDING FUEL OUT OF A SUPPLY TANK TO THE INTERNAL COMBUSTION ENGINE OF A MOTOR VEHICLE

STATE OF THE ART

The invention proceeds from an assembly for feeding fuel out of a supply tank to the internal combustion engine of a motor vehicle according to the preamble of claim 1.

Such a feed assembly is known from German Utility Model 92 10 600. This assembly has a feed pump with a feed member which rotates in a pump chamber. The pump chamber is delimited in the direction of the axis of rotation of the feed member by two walls which are located at a distance from one another and which are arranged in a stationary manner. A ring is arranged so as to surround the feed member and is clamped between the mutually confronting end faces of the walls. The ring serves for ensuring the axial play of the feed member between the two walls which is necessary for the reliable operation of the feed pump. In the first place, here, the distance between the mutually confronting end faces of the two walls and the thickness of the feed member must be determined and thereafter the ring can be selected in the necessary thickness and installed. This constitutes a considerable outlay in terms of the mounting of the feed assembly, and this should be avoided.

ADVANTAGES OF THE INVENTION

In contrast to this, the advantage of the assembly according to the invention for feeding fuel out of a supply tank to the internal combustion engine of a motor vehicle is that the feed member can be installed with a relatively large axial play, the feed member being held by the movable wall so as to bear on the stationary wall on account of the pressure force acting on said movable wall during operation, so that the feed member is arranged virtually without axial play in the pump chamber. Should dirt penetrate into the pump chamber, this does not cause the feed member to jam, since it can shift towards the movable wall.

Advantageous embodiments and developments of the invention are specified in the dependent claims.

DRAWING

An exemplary embodiment of the invention is illustrated in the drawing and explained in more detail in the following description. FIG. 1 shows a device for feeding fuel by means of a feed assembly out of a supply tank to the internal combustion engine of a motor vehicle in a greatly simplified basic representation, FIG. 2 shows part of the feed assembly in a longitudinal section, and FIG. 3 shows the feed assembly in a cross section along the line III—III in FIG. 2.

DESCRIPTION OF THE EXEMPLARY EMBODIMENT

Figure 1:
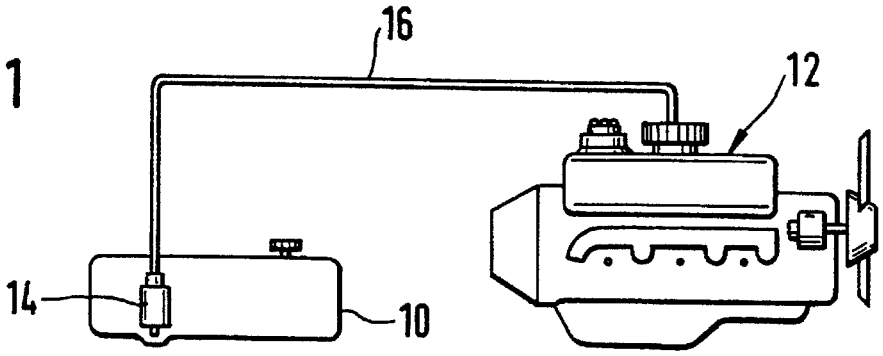

A device, illustrated in FIG. 1, for feeding fuel out of a supply tank 10 to the internal combustion engine 12 of a motor vehicle (not shown) has a feed assembly 14 which, in the exemplary embodiment, is arranged in the supply tank 10. The feed assembly 14 sucks up out of the supply tank 10, and its delivery side is connected via a conduit 16 to the internal combustion engine 12.

Figure 2:
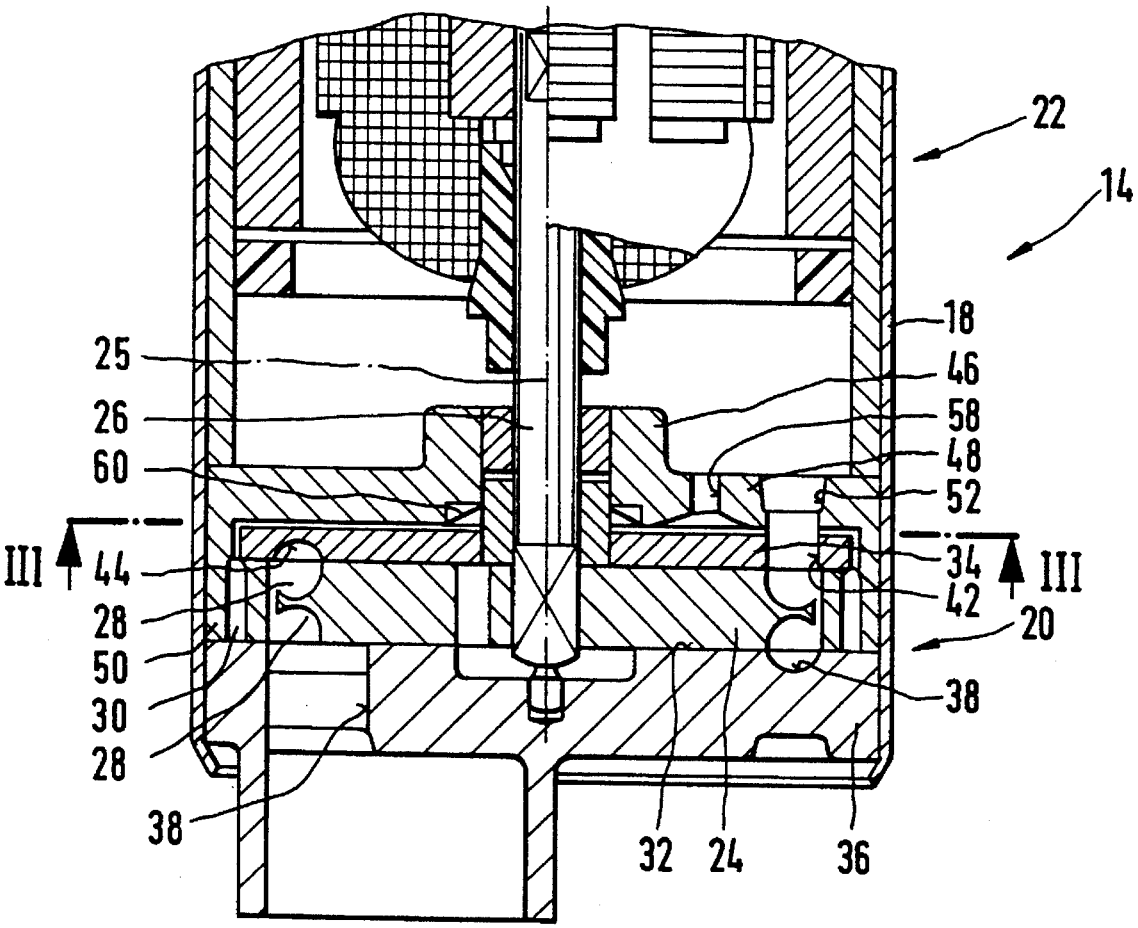

According to FIG. 2, the feed assembly 14 has a tubular housing 18, in which a feed pump 20 is arranged on one end region of the latter and an electric drive motor 22 is arranged adjacently to said feed pump 20. The feed pump 20 has a feed member 24 which is designed as a vane wheel and which is connected fixedly in terms of rotation to the armature shaft 26 of the drive motor 22, but is movable in the direction of its axis of rotation 25. The vane wheel 24 has a ring of vanes 28 on each of its two end faces on its circumferential region. The vane wheel 24 rotates in a pump chamber 30 which is delimited in the direction Of the axis of rotation 25 of the vane wheel 24 by two walls 32 and 34 located at a distance from one another. One wall 32 is formed on a closing part 36 which closes the housing 18 and which is connected in a stationary manner to the housing 18. Formed in the closing part 36 is a suction port 38, via which the feed pump 20 sucks up fuel out of the supply tank 10. Formed in the end face of the wall 32 confronting the vane wheel 24 is a feed duct 40 which, starting from the suction port 38, is approximately annular and which extends on the same diameter as the vane ring 28 located opposite in the end face of the vane wheel 24. The other wall 34 has a delivery port 42, through which fuel fed by the feed pump 20 emerges from the pump chamber 30. Likewise formed in the end face of the wall 34 confronting the vane wheel 24 is an approximately annular feed duct 44 which extends on the same diameter as the vane ring 28 located opposite in the end face of the vane wheel 24.

A pot-shaped insert part 46 is inserted into the housing 18 next to the wall 34 towards the drive motor 22. The wall 34 is separated from the adjacent drive motor 22 by the bottom 48 of the insert part 46. The wall 34 and the vane wheel 24 are arranged within the cylindrical wall 50 of the insert part 46 pointing to the closing part 36, and the pump chamber 30 is delimited in the radial direction relative to the axis of rotation 25 by the wall 50. The closing part 36 bears with the outer edge of its end face on the end face of the wall 50, so the pump chamber 30 is completely closed. The bottom 48 of the insert part 46 has a port 52 which is arranged in the region of the delivery port 42 of the wall 34, so that fuel fed by the feed pump 20 flows through the drive motor 22.

Figure 3:
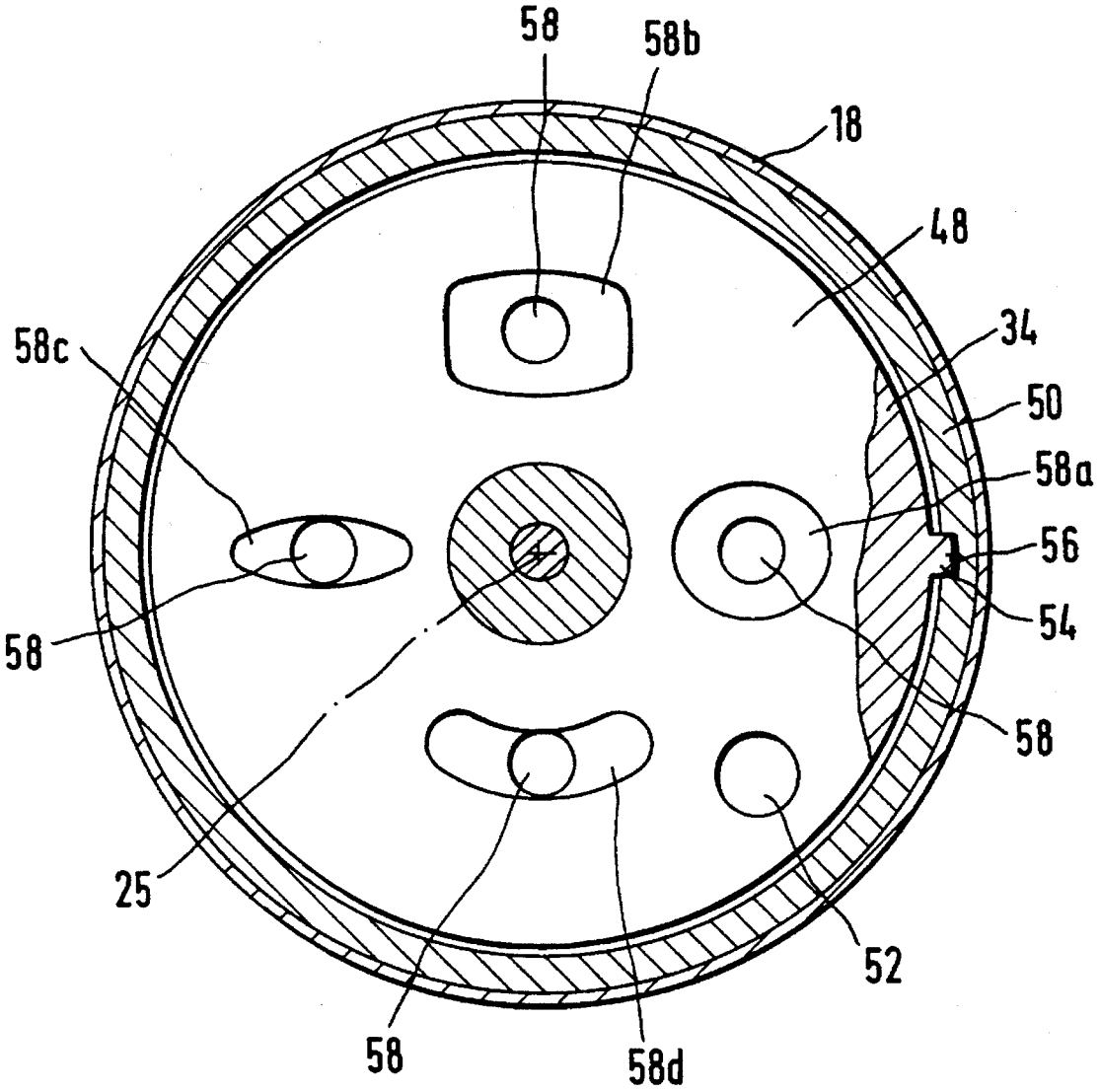

The wall 34 is movable relative to the insert part 46 in the direction of the axis of rotation 35 of the vane wheel 24, but is coupled to the insert part 46 in the direction of rotation about the axis of rotation 25. For securing the wall 34 against rotation, the latter possesses, as shown in FIG. 3, a nose 54 which projects outwards radially relative to the axis of rotation 25 and which penetrates into a corresponding depression or groove 56 extending in the direction of the axis of rotation 25 and located in the wall 50. The arrangement of the nose 54 and groove 56 can also be reversed, that is to say the nose is formed on the wall and the groove in the wall 34. Moreover, any other securing against rotation can also be provided. The wall 34 is made, in a cross section perpendicular to the axis of rotation 25, only a little smaller than the free cross section between the wall 50, so that the wall 34 is guided with minimal play radially relative to the axis of rotation 25 and, in the event of a movement along the axis of rotation 25, cannot become slanted and jam.

The wall 34 is adjacent to the bottom 48 of the insert part 46, in which at least one further port 58 is present radially at a shorter distance from the axis of rotation 25 than the port 52. By means of this further port 58, the end face of the wall 34 facing away from the vane wheel 24 is loaded by the feed pressure of the feed pump 20 prevailing in the region of the drive motor A plurality of ports 58 uniformly distributed over the circumference of the wall 34 are preferably provided, in order to achieve a uniform loading of the wall 34. The ports 58 can be designed so that their cross section increases towards the wall 34, that is to say the pressure-loaded area of the end face of the wall 34 is increased. As shown particularly in FIG. 3, the ports 58 can be widened towards the wall 34 in the form of pockets 58*a* or 58*b* of any shape or in the form of grooves 58*c* extending radially relative to the axis of rotation 25 or grooves 58*d* extending tangentially. The size of the pressure-loaded area of the end face of the wall 34 is dimensioned in such a way that, when the feed assembly 14 is in operation, the pressure force obtained is sufficient to press the wall 34 against the vane wheel 24 and to hold the vane wheel 24 in bearing contact on the end face of the opposite wall 32. Thus, when the feed assembly 14 is in operation, the vane wheel 24 is arranged in the pump chamber 30 without axial play in the direction of the axis of rotation 25. During the mounting of the feed assembly 14, the vane wheel 24 can be installed with any axial play which is greater than zero, so that a simple mounting of the feed assembly 14 becomes possible. If there are in the pump chamber 30 dirt particles which come between the mutually confronting end faces of the walls 32, 34 and of the vane wheel 24, then, as a result of a shift of the movable wall 34 in the direction of the axis of rotation 25, an increased axial play can be established, until the dirt particles are removed from the pump chamber 30 again, without jamming of the vane wheel 24 occurring.

In addition, there can be provided a resilient element 60, by which the wall 34 is loaded relative to the vane wheel 24 in the direction of the axis of rotation 25. The resilient element 60 can be clamped between the bottom 48 of the closing part 46 and the wall 34 and be designed, for example, as a cup spring.

The above-described design of the movable wall 34, which delimits the pump chamber 30 in the direction of the axis of rotation 25, is not restricted to use in flow pumps, but can also be employed in other versions of feed pumps, for example internal-gear pumps. Internal-gear pumps have as a feed member a toothed ring and a gearwheel which is arranged in the latter and on the end face of which the movable wall then bears.

I claim:

1. An assembly for feeding fuel out of a supply tank to an internal combustion engine of a motor vehicle, the assembly comprising a feed pump including means forming a pump chamber, a feed member rotatable in said pump chamber about an axis of rotation and also movable in said pump chamber in direction of said axis of rotation, said means including two walls spaced from one another in the direction of said axis of rotation and including one stationary wall which is arranged in a stationary manner and another movable wall which is movable in the direction of said axis of rotation of said feed member but is not rotatable about said axis of rotation, said feed pump being formed so that said movable wall on its end face facing away from said feed member is loaded at least in regions by a feed pressure prevailing on a delivery side of said feed pump, so that when the feed assembly is in operation, said movable wall comes to bear on said feed member and exerts on said feed member a force directed toward said stationary wall.

2. An assembly as defined in claim 1; and further comprising a housing accommodating said feed pump; a closing part which closes said housing; and a drive motor connected to said delivery side of said feed pump, said stationary wall being arranged on said closing part while said movable wall is arranged toward said drive motor.

3. An assembly as defined in claim 2; and further comprising means forming a space in which said drive motor is arranged; and a further component separating said movable wall of said feed pump from said drive motor, said further component having at least one part which connects said end face of said movable wall at least in regions to said space in which said drive motor is arranged.

4. An assembly as defined in claim 1; and further comprising a component in which said movable wall is guided with minimal play in a radial direction relative to said axis of rotation of said feed member.

5. An assembly as defined in claim 4; and further comprising a drive motor, said component having a cylindrical wall portion in which said movable wall is guided, and a bottom portion by which said movable wall is separated from said drive motor.

6. An assembly as defined in claim 1; and further comprising a motor; and means forming at least one port which has a cross-section increasing starting from said drive motor towards said movable wall.

7. An assembly as defined in claim 1; and further comprising a resilient element which engages on said movable wall so as to act towards said stationary wall.

8. An assembly as defined in claim 7; and further comprising a component which guides said movable wall with minimal play in a radial direction relative to said axis of rotation of said feed member, said component having a bottom portion which supports said resilient element.

9. An assembly as defined in claim 1, wherein said feed member is formed as a vane wheel having end faces and a ring of vanes in each of said end faces, said feed pump having a substantially annular feed duct arranged in said end faces of said walls which face said vane wheel.

* * * * *